US005965318A

United States Patent [19]

Goedeweeck et al.

[11] Patent Number: 5,965,318

[45] Date of Patent: Oct. 12, 1999

[54] PHOTOGRAPHIC SILVER HALIDE MATERIAL FOR MAMMOGRAPHY

[75] Inventors: Rudy Goedeweeck, Rotselaar; Guy Vastenaeken, Wespelaar; Luc Heremans, Leuven; Kathy Elst, Kessel, all of Belgium

[73] Assignee: AGFA-Gevaert, N.V., Mortsel, Belgium

[21] Appl. No.: 09/050,020

[22] Filed: Mar. 30, 1998

[30] Foreign Application Priority Data

Apr. 23, 1997 [EP] European Pat. Off. ..... 97201194

[51] Int. Cl.[6] ..... G03C 5/17; G03C 5/16; G03C 1/035

[52] U.S. Cl. ..... 430/139; 430/567; 430/966

[58] Field of Search ..... 430/139, 567, 430/966

[56] References Cited

U.S. PATENT DOCUMENTS

| | | | |
|---|---|---|---|
| 5,290,655 | 3/1994 | Iwasaki | 430/139 |
| 5,449,599 | 9/1995 | Heremans | 430/567 |
| 5,460,916 | 10/1995 | Iwasaki | 430/139 |
| 5,759,754 | 6/1998 | Dickerson | 430/502 |
| 5,853,967 | 12/1998 | Dickerson | 430/502 |
| 5,856,077 | 1/1999 | Dickerson et al. | 430/510 |

FOREIGN PATENT DOCUMENTS

| | | | |
|---|---|---|---|
| 530 129 | 7/1954 | Belgium . | |
| 0 530 117 A1 | 3/1993 | European Pat. Off. | G03C 5/17 |

*Primary Examiner*—Mark F. Huff
*Attorney, Agent, or Firm*—Breiner & Breiner

[57] ABSTRACT

A photographic silver halide material and a method using said material for mammography are disclosed. The photographic material has a large dynamic range and a high contrast, so that lesions deep in the glandular tissue are accurately detected, and also clearly depicts thin tissue such as the skin line of the breast. The sensitometric curve of optical density versus logarithmic exposure logE of said photographic material is characterised by (i) an average gradation of at least 3.5 between Dmin+1.0 and Dmin+2.5; and (ii) a local gradient ranging from 0.7 to 1.8 and an optical density not higher than 3.5 at the point where logE equals SP+0.8 (SP being defined as the logE at which the optical density equals Dmin+1.0); and (iii) an optical density of at least 3.7 at the point where logE equals SP+1.3.

10 Claims, 1 Drawing Sheet

PHOTOGRAPHIC SILVER HALIDE MATERIAL FOR MAMMOGRAPHY

FIELD OF THE INVENTION

This invention relates to a photographic silver halide material and a radiological method using said material for mammography.

BACKGROUND OF THE INVENTION

The incidence of breast cancer carcinoma among women continues to increase, posing a serious health problem throughout the world. The mortality rate from breast cancer can be decreased significantly by early detection using the radiological mammography technique. With this technique the compressed breast is irradiated with soft X-rays emitted from an X-ray generating device and the modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box.

No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image colour and skin line perceptibility. It is common practice to set the amount of X-ray exposure so that the tissues on the inside of the breast are depicted at medium optical density values, i.e. in the optical density range from Dmin+1.0 to Dmin+2.5 (Dmin being defined as the base+fog density obtained after processing the unexposed film), and the diagnostic perceptibility of small, potentially malignant lesions in these tissues is highly determined by the contrast of the mammography film within said density range. A quantitative measure of the film contrast is the so-called average gradation, defined as the slope of the line drawn by connecting both points of the sensitometric curve of optical density vs. logarithmic exposure at which the optical density is equal to Dmin+1.0 and Dmin+2.5.

Conventional mammography films can roughly be classified in low and high contrast types according to the value of their average gradation as defined above. The low contrast type can be characterised by a relatively low average gradation ranging from 2.0 to 2.5 whereas the average gradation of the high contrast type may range from 3.0 to 3.5. Often, high contrast films are preferred because of the higher ability to detect tiny cancers deep in the glandular tissue of the breast. If the contrast is too high, however, it may preclude visualisation of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach is described in U.S. Pat. No. 5,290,665.

In order to extend the exposure latitude some manufacturers have introduced high contrast mammography films characterised by a higher maximum density (hereinafter referred to as Dmax) than conventional high contrast films, e.g. a Dmax equal to at least 3.7, preferably even higher than 4.0. However, a film characterised by a higher Dmax is only a minor improvement with regard to better skin line perceptibility, since the background density is too high for the skin line to be clearly visible. Indeed at optical density values above 3.5, the local gradient, i.e. the slope of the sensitometric curve must be very high in order to guarantee a reasonable perceptibility as described in the classic article 'Determination of optimum film density range for rbntgenograms from visual effect' by H. Kanamori (Acta Radiol. Diagn. Vol.4, p. 463, 1966). Nevertheless, mammography films with a higher Dmax are appreciated by a growing number of radiologists because of the wider dynamic range, i.e. the density range Dmax–Dmin of the mammogram.

As a conclusion, it remains difficult to obtain mammograms with high contrast and high Dmax that also clearly depict thin tissue such as the skin line of the breast. Some improvements have been obtained by modifying the X-ray generating device, such as the scanning mammography system described in U.S. Pat. No. 5,164,976. These solutions however require the replacement of the conventional X-ray apparatus by a completely new system of a much higher technical complexity.

Maintaining the image quality constant is becoming another requirement of facilities performing mammography. Accordingly, quality control tests are executed on a regular basis in order to monitor the consistency of the performance of the X-ray equipment, the image receptors and the film processor. To minimise the influence of varying film processing time, temperature, chemistry and replenishment, a preferred mammography film requires a stable speed and contrast with regard to these processing parameters. In addition, there is a general trend in the field of radiology to shorten the film processing time and likewise in the field of mammography, being driven by intensified screening programs, the interest has focused on rapid access of mammograms. As a consequence, mammography films are preferred which comprise silver halide crystals that can be processed rapidly and consistently in a dry-to-dry processing cycle of 90 seconds or less and therefore, most mammography films today comprise good developable cubic silver halide crystals. As described in the European Patent Application No. 712,036, such cubic crystals show a stable speed and contrast upon varying processing parameters. Cubic emulsions however are characterised by a very high contrast, resulting in a poor skin line perceptibility.

On the other hand tabular silver halide emulsion crystals, also being rapidly processable, are characterised by a much lower contrast than cubic silver halide emulsions and thus are only applicable for manufacturing low contrast mammography films. Another drawback of these tabular emulsions is the residual colour after processing: due to the larger specific area of the tabular grains compared e.g. with cubic crystals having the same crystal volume, these tabular grains require higher amounts of spectrally sensitising dye(s), which may leave dye stain after the short processing cycle. Also the brownish colour of the developed silver image of thin tabular grains is a disadvantage for mammography.

SUMMARY OF THE INVENTION

It is therefore a first object of this invention to provide a photographic material for mammography which is not only characterised by a high diagnostic quality, manifested by a large dynamic range and a high contrast so that small lesions deep in the glandular tissue are accurately detected, but which also clearly depicts thin tissue such as the skin line of the breast. The above mentioned object is realised according to the present invention by a photographic material having the specific features according to claim 1.

It is another object of the present invention to provide said photographic material comprising silver halide emulsion crystals which are rapidly processable and provide a neutral silver image colour without leaving residual sensitising dye after processing. This object is realised by the preferred embodiments of said photographic material disclosed in claims 5 and 6.

It is even a further object of this invention to provide a radiological method using the photographic material according to the present invention for obtaining a diagnostic image for mammography, said method being disclosed in claims 9.

Further objects and advantages of this invention, which may be obtained by specific embodiments, will become apparent from the description hereinafter.

DETAILED DESCRIPTION OF THE INVENTION

Figure 1:
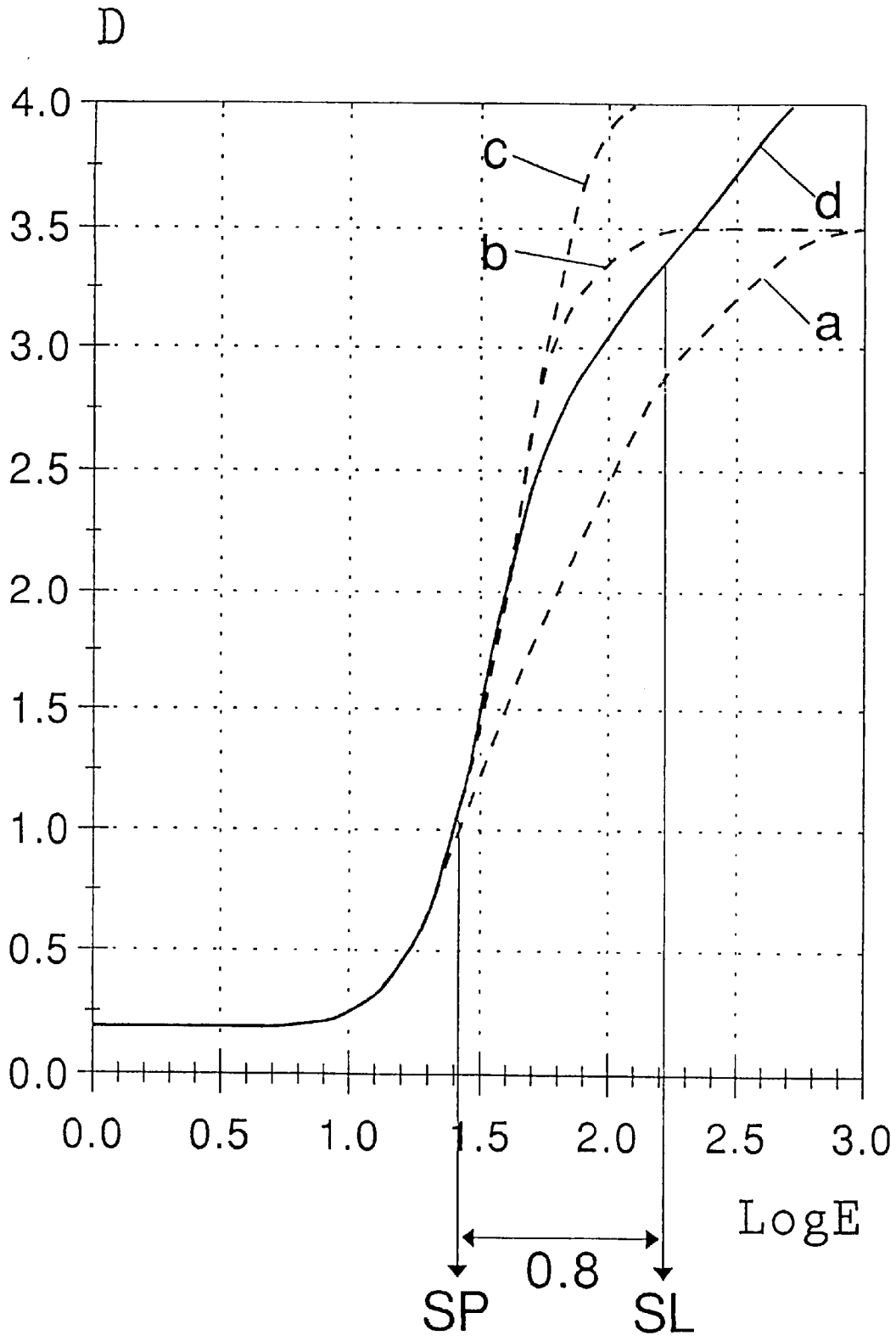

FIG. 1, wherein optical density (D) is plotted as a function of relative logarithmic exposure (logE), shows (i) curves (a), (b) and (c), representing the sensitometric curves of prior art materials respectively (a) a low contrast mammography film, (b) a high contrast mammography film and (c) a high contrast mammography film with high Dmax; and (ii) curve (d) which is the sensitometric curve of a representative material according to the present invention; and (iii) the speed point (SP) of said curves being defined herein as the logE at which the optical density is equal to Dmin+1.0; and (iv) the skin line point (SL) being defined herein as the point of the sensitometric curve where logE is equal to SP+0.8.

The sensitometric curves given in FIG. 1 can be obtained by test T defined hereinafter, though it will be understood that it is not intended to limit the invention only to the sensitometric curves obtained by the specific features of this test. On the contrary, it is intended to cover all photographic materials for mammography which are characterised by a sensitometric curve as claimed, regardless the method of exposing and processing said materials. Test T comprises the following steps :

(i) subjecting the photographic material to stepwise exposure to visible light; and (ii) developing said exposed photographic material during 12 seconds at a temperature of 37° C. with a developer having the following composition:

| | |
|---|---|
| hydroquinone | 30 g |
| 1-phenyl-3-pyrazolidone | 1.5 g |
| acetic acid 99% | 9.5 ml |
| potassium sulphite | 63.7 g |
| potassium chloride | 0.8 g |
| ethylenediaminetetraacetate, di-sodium salt | 2.1 g |
| potassium carbonate | 32 g |
| potassium metabisulphite | 9 g |
| potassium hydroxide | 14 g |
| diethyleneglycol | 25 ml |
| 6-methylbenztriazole | 0.09 g |
| glutardialdehyde, 50 wt. % aqueous solution | 9.5 ml |
| 5-nitroindazole | 0.25 g |
| demineralised water to make 1 l. | |

The starter solution to be added has the following composition:

| | |
|---|---|
| acetic acid 99% | 15.5 ml |
| potassium bromide | 16 g |
| demineralised water up to 100 ml. | |

(iii) fixing with a conventional thiosulphate fixing bath; and (iv) rinsing with water and drying.

Though the above described test T comprises the step of exposing the photographic material to visible light, it is clear that a practical mammogram is obtained by subjecting a film-screen system to X-ray exposure. In the diagnostic image forming method according to the present invention any commercially available X-ray generating device may be used, providing an exposure to soft X-rays with a tube voltage of 20 to 40 kV. A preferred luminescent phosphor coated in the X-ray conversion screen is $Gd_2O_2S$:Tb, which emits green light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in British Patent No. 1,489,398. Phosphor screens with emission spectra in other wavelength ranges, e.g. in the blue spectrum, may also be applicable. The thickness of the phosphor layer depends on the amount of coated phosphor required to obtain the desired screen speed. A preferred intensifying screen used in the method according to this invention is characterised by a phosphor coating weight of at least 45 mg/cm$^2$ and a phosphor to binder ratio of at least 97:3 as described in the European Patent Application No. 712,036.

In order to obtain a satisfactory image resolution, mammography films comprise one or more light-sensitive emulsion layer(s) on only one side of a transparent support, which is typically a blue coloured polyethyleneterephtalate film having a thickness of 175 $\mu$m. Preferably one or more backing layer(s), which operate as anti-halation and anti-curl layer, are present on the opposite side of said support. One or more subbing layers may be coated directly on the support to improve the adhesion of the emulsion and backing layer(s) to the support. In addition, an undercoat layer between the emulsion and subbing layer(s) and a protective layer on top of the emulsion layer(s) may be present. Additional non light-sensitive intermediate layers are optional.

The light-sensitive emulsion layer(s) of the photographic materials according to the present invention comprise(s) silver halide crystals, also called grains, having an average grain size, defined herein as the diameter of the sphere having the same volume as the grain, which may range from 0.1 to 1.0 $\mu$m. The grain size can be determined using conventional techniques, e.g. as described by Trivelli and Smith, The Photographic Journal, vol. 69, 1939, p.330–338, Loveland "ASTM symposium on light microscopy" 1953, p.94–122 and Mees and James "The Theory of the photographic process" (1977), Chapter II. The silver halide grains are obtained by conventional precipitation techniques which are well known in the art and consist of the addition of aqueous solutions of silver and halide salts, e.g. silver nitrate and sodium, potassium or ammonium halide, to a solution comprising a protective colloid.

In a preferred embodiment, the light-sensitive emulsion layer(s) of the material according to the present invention comprise(s) cubic and/or tabular silver halide grains as will be illustrated in detail by the working examples. The class of so-called cubic grains embraces (a) perfectly cubic crystals, or (b) cubic crystals with rounded corners, or (c) cubic crystals with small (111) faces at the corners (also known as tetradecahedrical grains), the total area of these (111) faces however being small compared to the total area of the (100) faces. Moreover a cubo-octahedral shape is not excluded and the actual morphology of the grains obtained depends on the pAg values applied during the precipitation. Preferred methods for the precipitation of cubic grains are the pAg-balanced double- or triple-jet methods as described in the European Patent Application Nos. 712,036 and 610,609, herein incorporated by reference, since these methods provide monodispersed emulsions characterised by a narrow grain size distribution defined in that at least 95% by weight or number of the grains have a diameter within about 40%, preferably within about 30% of the average grain size and more preferably within about 10% to 20%. The variation coefficient of the emulsion grains according to this invention has preferably a low value of between 0.15 and 0.20, and still more preferably of 0.10, said variation coefficient being defined as the ratio between the standard deviation of the grain size and the average grain size.

Tabular silver halide grains are crystals possessing two parallel (111) faces with a ratio of the diameter of a circle having the same area as these faces versus the thickness, being the distance between the two major faces, equal to at least 2. The precipitation methods of tabular silver halide grains are also extensively described in patent literature. Preferred methods, providing relatively narrow grain size distributions with a variation coefficient of less than 0.30, are described in e.g. U.S. Pat. No. 5,290,655 and European Patent Application No. 569,075.

Though the silver halide grains of the present invention may comprise chloride, bromide or iodide and any combination thereof, the preferred cubic and tabular emulsions comprise silver bromide or silver iodobromide grains having an average iodide content of at most 5 molar % and more preferably at most 1 molar %. The iodide distribution can be homogenous over the whole crystal volume or may be present as a so-called core-shell crystal structure, i.e. a silver halide crystal having distinct phases characterised by a different iodide to bromide ratio. More than one shell can be present and between different phases it can be recommended to have a phase enriched in silver iodide by applying the so-called conversion technique during precipitation. Iodide ions can be provided by adding aqueous solutions of inorganic salts thereof as e.g. sodium, potassium or ammonium iodide or by adding organic compounds which are capable of releasing iodide ions as described in the European Patent Application Nos. 561,415; 563,701; 563,708; 649,052 and 651,284.

The precipitation of the silver halide crystals according to this invention is performed in the presence of a protective, hydrophilic colloid, e.g. conventional lime-treated or acid treated gelatin but also oxidised gelatin or a synthetic peptiser may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium. Cubic and tabular silver halide grains may also be precipitated in absence of gelatine by using colloidal silica as a protective colloid in the presence of an onium compound, as described in European Patent Application Nos. 677,773 and 649,051.

In order to control the grain size, grain growth restrainers or accelerators may be used during the precipitation or the flow rate or concentration of the silver and halide salt solutions, the temperature, pAg, physical ripening time, etc. may be varied. Silver halide solvents such as ammonia, a thioether compound, thazolidine-2-thione, tetra-substituted thiourea, potassium or ammonium rhodanide and an amine compound may be present during grain precipitation in order to adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps. Another well-known washing technique is ultrafiltration. Finally, extra gelatin can be added to the emulsion so as to obtain a gelatin to silver ratio which is optimized with respect to the coating conditions and/or to establish the required thickness of the coated emulsion layer. Preferably a gelatin to silver halide weight ratio ranging from 0.3 to 1.0 is then obtained.

The silver halide emulsions may be chemically sensitised according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitisation can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and British Patent No. 618,061 may be used. The amount of gold, used in the chemical ripening of emulsions according to the present invention, is preferably in the range of 25 to 45 ppm vs. the amount of metallic silver. Additions of sulphur and/or selenium and/or tellurium and gold may be carried out consecutively or simultaneously. In the latter case the addition of goldthiosulphate, goldselenosulphate or gold-tellurosulphate compounds may be recommended. Optionally, small amounts of compounds of Rh, Ru, Pb, Cd, Hg, or Tl can be added.

Also reductors may be added as chemical sensitisers e.g. tin compounds as described in British Patent No. 789,823, amines, hydrazine derivatives, formamidine-sulphinic acids, and silane compounds. The chemical sensitisation can also proceed in the presence of phenidone and/or its derivatives, a dihydroxybenzene as hydroquinone, resorcinol, catechol and/or a derivative(s) thereof, one or more stabiliser(s) or antifoggant(s), one or more spectral sensitiser(s) or combinations of said ingredients.

The silver halide grains present in a mammography film are spectrally sensitised so as to optimally detect the light emitted from the X-ray conversion screen. A preferred mammography film is characterised by a spectral sensitivity ranging from 5 to 80 microJoules per $m^2$ measured at the emission maximum of the X-ray conversion screen, said spectral sensitivity being defined herein as the amount of exposure to light of a given wavelength required to obtain an optical density Dmin+1.0 after processing.

The silver halide emulsion can be spectrally sensitised by adding one or several cyanine dyes, merocyanine dyes, complex cyanine dyes, complex merocyanine dyes, hemicyanine dyes, styryl dyes and hemioxonol dyes. Preferred examples of suitable orthochromatic spectral sensitisers are 5,5'-dichloro-3,3'-bis($SO_3$-R)-9-ethylbenzoxacarbocyanines with R being n-propylene or n-butylene. Furthermore, green-light absorbing spectral sensitisers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitisers or combinations thereof is always related to the purpose of obtaining the highest possible photographic speed while reducing dye stain after processing. Another survey of useful chemical classes of spectral sensitisers is described by F. M. Hamer in "The Cyanine Dyes and Related Compounds", 1964, John Wiley & Sons and other examples specifically useful for spectral sensitisation of tabular grains are given in Research Disclosure Item 22534. In addition, a more recent overview is given in European Patent Application No. 757,285 filed Aug. 1, 1995, which is incorporated herein by reference.

Traditionally spectral sensitisation follows the completion of chemical sensitisation. However, the spectral sensitisation of tabular grains in particular may occur simultaneously with or even precede completely the chemical sensitisation step: it is generally recognised that spectral sensitisers may act as site-directors during the formation of sensitivity specks by the chemical sensitisation of tabular grains, thereby enhancing their photographic properties.

Other dyes, which per se do not have any spectral sensitisation activity, or certain other compounds, which do not substantially absorb visible radiation, can have a supersensitisation effect when they are incorporated together with said spectral sensitising agents into the emulsion. Suitable supersensitisers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitising dye can be added to an emulsion layer or to one or more non-light-sensitive hydrophilic layers such as the backing layer(s). The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in European Patent Application Nos. 384,633; 351,593; 586,748; 587,230 and 656,401, European Patent Nos. 323,729; 274,723 and 276,566, and in U.S. Pat. Nos. 4,900,653; 4,904,565; 4,949,654; 4,940,654; 4,948,717; 4,988,611; 4,803,150 and 5,344,749. Said dyes can also be added in the form of a solid silica particle dispersion as disclosed in European Patent Application No. 569,074. Still another technique to obtain ultra fine dye dispersions consists in acidifying a slightly alkaline coating composition "in situ" just before coating it onto the supporting layer.

The silver halide emulsions according to the present invention may also comprise compounds preventing the formation of a high minimum density or stabilising the photographic properties during the production or storage of photographic materials or during the photographic treatment thereof. Many known compounds can be added as fog-inhibiting agent or stabiliser to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-*a*]-pyrirnidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chapter VI. These fog-inhibiting agents or stabilisers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. Nos. 4,063,952 and with the onium compounds as disclosed in European Patent Application No. 408,143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitisation and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0,634,688 and 0,674,215, which are incorporated herein by reference. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticisers, antistatic agents, etc. Suitable additives for improving the dimensional stability are i.a. dispersions of a water-soluble or hardly soluble synthetic polymer e.g. polymers of alkyl (meth)acrylates, alkoxy-(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticiser for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex and the like.

Preferably, the photographic materials according to the present invention are characterised by a neutral silver image tone, obtained after exposure and processing. It is well known that thin tabular emulsion grains may produce a brownish, yellow or even reddish image tone and therefore, tabular grains having an average thickness of 0.2 μm or more are preferred. On the other hand, a thickness less than 0.3 μm is also preferred since thicker grains are characterised by a lower covering power of the developed silver, requiring a large amount of silver halide to be present in the photographic material in order to obtain a satisfactory maximum density. Methods to prepare thicker tabular grains have already been described in U.S. Pat. Nos. 4,801,522; 5,028,521 and 5,013,641 and EP-A 0 569 075.

The non-neutral silver image color can be corrected by increasing the optical density in the red region of the visible spectrum by adding suitable dyes to the support or any coated layer. This non-image wise color correction method has been disclosed in references as e.g. JP-A's 03,100,645; 01,029,838; 01,312,536; 03,103,846; 03,094,249; 03,255,435; 61,285,445; EP-B 271,309 and U.S. Pat. No. 4,861,702. This method however may result in an excessive base+fog density of the photographic material and therefore, a alternative way consists in an image-wise color correction by using color-forming developers, which are blue colored in their oxidised form. Examples thereof are summarised in JP-A's 03,153,234; 03,154,043 and 03,154,046. In JP-A's 03,156,447 and 03,157,645 the adsorption of a blue colored dye as a function of exposure has further been disclosed. Another method to improve the image tone of tabular grain emulsions consists of mixing them with chloride containing cubic grains, as disclosed in European Patent Application No. 96,202,507, filed Sep. 9, 1996.

In addition, the photographic material may comprise preferably in the emulsion layer(s) a compound corresponding to the following formula:

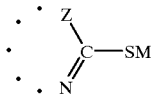

wherein Z represents a group of atoms necessary to form a 5- or 6-membered ring and M represents a hydrogen atom, an alkali metal atom or an ammonium group. The compounds of the above formula are preferably added in an amount from $10^{-6}$ to $10^{-2}$, more preferably $10^{-5}$ to $10^{-3}$ mole per mole of silver in the emulsion layer(s). Representative examples of these compounds are given in U.S. Pat. No. 5,290,655.

While the present invention will hereinafter be illustrated by working examples representing preferred embodiments thereof, it will be understood that it is not intended to limit the invention to those embodiments.

EXAMPLES

Preparation of Tabular Emulsion T1

To a solution of 5.5 g oxidised gelatine (less than 30 μmole methionine per g) in 3 l water, adjusted to a pBr of 2.4 by adding KBr and a pH of 1.7 by adding $H_2SO_4$, were added by a double jet method aqueous solutions of 1.96 M $AgNO_3$ (hereinafter referred to as S1) and 1.96 M KBr (hereinafter referred to as S2) both at a constant flow rate of 16 ml/min during 27 seconds. During this period, the reaction mixture was maintained at 51° C. When the addition was completed, stirring continued during 1.5 minutes and then, temperature was increased up to 70° C. over a period of 25 minutes, followed by the addition of a NaOH solution over a period of one minute to adjust pH to 5.6. Then stirring continued for 2.5 minutes and 0.5 1 of a 10% gelatine solution kept at 70° C. was added. After stirring during another 5.5 minutes, S2 was added in a single jet at 7.5 ml/min over a period of 5.5 minutes. Then S1 at a constant flow rate of 7.5 ml/min and S2 at a flow rate, controlled to maintain pAg at 8.9, were added in a double jet over a period of 1 minute. This double jet was continued during another period of 33 minutes and 23 seconds, while the flow rate of S1 was linearly increased up to 23.1 ml/min and pAg was maintained at 8.9. 5 minutes after the completion of said double jet addition, S1 was added at 7.5 ml/min during 7 minutes and 20 seconds. Then another double jet started of S1 at 7.5 ml/min during 1 minute and 40 seconds and an aqueous solution of 1.93 M KBr and 0.03 M KI at a controlled flow rate to maintain pAg at 7.4. This double jet was continued during another period of 40 minutes and 56 seconds, while the flow rate of S1 was linearly increased up to 36.8 ml/min and pAg was maintained at 7.4. The average grain size of the emulsion thus prepared was 0.60 μm, the average thickness was 0.22 μm and the variation coefficient was 0.25. The iodide content was 1 molar %.

After washing, gelatine and water were added to obtain a silver halide content of 245 g/kg, expressed as $AgNO_3$, and a gelatin content of 83 g/kg. To 2 kg of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, 1170 ml of a 0.25 wt. % solution of anhydro-5,5'-dichloro-3,3'-bis(n-butyl-4-sulphonate)-9-ethylbenzoxacarbocyanine triethylammonium salt, 9 mg sodium thiosulphate, 5.3 ml of a solution containing $1.46\times10^{-3}$ M chlorauric acid and $1.58\times10^{-2}$ M ammonium rhodanide, and finally 10 ml of a 1 wt. % solution of 1-(p-carboxyfenyl)-5-mercapto-tetrazole and this mixture was chemically ripened during 4 hours at 48° C. After cooling, a preservative was added.

Preparation of Cubic Emulsion C1

To 1 l of a solution, containing 15 g methionine and 50 g gelatin, adjusted to pH 5.8 and kept at 60° C., were added in a double jet a 2.94 M $AgNO_3$ solution at a constant flow rate of 5.7 ml/min during 5 seconds and a solution of 2.91 KBr and 0.03 M KI at a flow rate controlled to maintain pAg constant at 7.8. Then the flow rate of the $AgNO_3$ solution was increased linearly up to 21 ml/min during 72 minutes and 46 seconds. The cubic grains thus prepared consisted of 99% AgBr and 1% AgI with an average grain size of 0.63 μm. After washing, gelatine and water were added to obtain a silver halide content of 208 g/kg, expressed as $AgNO_3$, and a gelatin content of 83 g/kg. To 2.4 kg of this emulsion, of which pH was adjusted to 6.0, were added consecutively 6 mg sodium thiosulphate, 70 ml of a solution containing $1.46\times10^{-3}$ M chlorauric acid and $1.58\times10^{-2}$ M ammonium rhodanide, 2 ml of a $4.76\times10^{-3}$ M solution of sodium toluenethiosulphonate in methanol and 38 mg sodium sulphite. This mixture was chemically ripened during 4 hours at 46° C. After cooling, a preservative was added.

Preparation of Cubic Emulsions C2, C3 and C4

Cubic emulsions C2, C3 and C4 were prepared according to the same procedure as described for emulsion C1 but with adjusted flow rates during the nucleation step in order to obtain crystals with an average grain size of 0.52 μm, 0.45 μm and 0.35 μm respectively.

TABLE 1

| Compound (amounts per mole silver halide) | Lower emulsion layer A | Upper emulsion layer B |
|---|---|---|
| 5,5'-dichloro-3,3'-bis(n-butyl-4-sulphonate)-9-ethylbenzoxacarbocyanine, anhydrous triethylammonium salt | 50 mg[(a)] | 375 mg |
| 4-hydroxy-6-methyl-1,3,3a,7-tetraazaindene | 87 mg | 785 mg |
| bis-metasulphophenyl-disulphide | — | 50 mg |
| 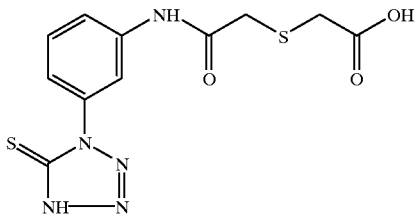 | 33 mg | — |
| sorbitol | 15.5 g | 15.5 g |
| polyethylacrylate, latex platiciser | 12 g | 12 g |
| phloroglucinol | 195 mg | 39 mg |
| resorcinol | 2.8 g | 2.8 g |
| potassium bromide | 160 mg | 160 mg |
| polydextran (M.W. 10,000) | 15 g | 40 g |

[(a)]an extra amount of 175 mg was added for preparing the coating solution of lower emulsion layer A of example No. 12 which contains no tabular emulsion T1 in said layer.

TABLE 2

| Compound | amounts per $m^2$ |
|---|---|
| gelatin | 1.1 g |
| polymethylmethacrylate spacing agent (average particle diameter 3 $\mu$m) | 15 mg |
| chromium acetate | 5.5 mg |
| 4-hydroxy-6-methyl-1,3,3a,7-tetraazaindene | 82 mg |
| bis-metasulphophenyl-disulphide | 4 mg |
| $CF_3$—$(CF_2)_6$—COOH.NH3 | 7.5 mg |
| $CF_3$—$(CF_2)_6$—CONH—$(CH_2CH_2O)_{17-20}$—H | 19 mg |
| phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A [(a)] | 5 mg |
| formaldehyde (added just before coating) | 100 mg |

(a) Polythioether A is a modified poly-epichloorhydrine having an average chain length of approximately 20 monomer units and of which about 50% of the chloride groups have been replaced by a —S—$CH_2$—CHOH—$CH_2$OH substituent.

Coating of the Materials

The photographic materials according to these examples comprise one or two emulsion layers and one protective layer. The coating solutions of the emulsion layers were prepared by adding solutions of the compounds indicated in table 1 to the melted emulsion while stirring. The coating solution of the protective layer is given in table 2. After adjusting pH to 6.7, the viscosity and surface tension of the coating solutions were optimised according to the requirements of the coating method. The emulsion layer(s) and the protective layer were coated simultaneously on one side of a substrated polyester support having a thickness of 175 $\mu$m by means of conventional coating techniques. The silver coverage of the emulsions is given in table 3. At the opposite side a conventional anti-curl and anti-halation layer was applied.

Results

After drying and hardening, the materials were subjected to test T defined above and the resulting sensitometric parameters are listed in table 3. All the examples had a comparable photographic speed, being the highest at a wavelength of about 545 nm and corresponding to an exposure amount at said wavelength of about 20 micro-Joules per $m^2$, required to obtain an optical density Dmin+1.0.

As specified in the appending claims, the mammography films according to the present invention are characterised by specific values of four important sensitometric parameters in order to obtain a high contrast and a large dynamic range as well as good skin line perceptibility:

(i) Av.Grad.: the average gradation at medium densities, defined as the slope of the line drawn by connecting the points at which the optical density is equal to Dmin+1.0 and Dmin+2.5; as described above, this parameter corresponds to the perceived diagnostic contrast as a higher value provides better diagnostic information;

(ii) Gr.SL: the local gradient $\delta D/\delta \log E$ at the skin line point (SL), defined above;

(iii) D.SL: the optical density at the skin line point (SL);

(iv) PDmax: the maximum density obtained in a practical diagnostic image, defined herein as the optical density at the point where logE is equal to SP+1.3; as indicated above, this parameter is a measure for the perceived dynamic range.

The values of said four sensitometric parameters are given in table 3 for all the samples prepared, as well as the so-called skin line factor being an average measure for the skin line perceptibility, which was obtained by visual inspection of the samples by several observers. The value of this skin line factor may range from 0 to 5 with a higher number indicating a better skin line perceptibility. A value of 3 corresponds to a 'good' skin line perceptibility and 5 or higher is 'excellent'.

Comparative example 1 is a material having a single emulsion layer comprising only tabular emulsion T1. This sample is characterised by a relatively low diagnostic contrast (Av.Grad.) and its sensitometric curve is comparable to curve (a) of FIG. 1, though PDmax is higher. As this material comprises only tabular emulsion which contains high amounts of spectral sensitiser, an unacceptable dye stain remains after processing. Comparative example 2 is also a single emulsion layer material containing 7.0 g/$m^2$ of cubic emulsion C1 and its sensitometric curve corresponds to mammography films of type (b) in FIG. 1. This sample shows no dye stain and high diagnostic contrast (Av.Grad.), but a relatively small dynamic range (PDmax) and poor skin line perceptibility (low skin line factor). Comparative example 3 is characterised by a higher coating weight of the same emulsion as example 2 and corresponds to mammography films of type (c) in FIG. 1. Diagnostic contrast (Av.Grad.) and dynamic range (PDmax) of example 3 are excellent but skin line perceptibility remains poor.

The examples 4 through 11 are dual emulsion layer materials of which the lower emulsion layer A and the upper emulsion layer B contain different emulsions in the amounts indicated in table 3. The data in table 3 illustrate that the sensitometric parameters Gr.SL and D.SL are highly correlated to the amounts of tabular emulsion T1 in layer A and cubic emulsion C1 or C2 in layer B. The best skin line perceptibility is obtained when limiting the values of Gr.SL and D.SL to the ranges as defined in the appending claims.

Preferred embodiments of the present invention are characterised by a neutral silver image tone which may be obtained by using tabular grains having a thickness higher than 0.2 $\mu$m. Preferred materials of the present invention show substantially no dye stain after processing, which may be obtained by limiting the emulsion coating weight of the layer comprising the tabular grains to less than 50% of the total silver coverage of the material.

Having described in detail preferred embodiments of the present invention, it will now be apparent to those skilled in the art that numerous modifications can be made therein without departing from the scope of the invention as defined in the appending claims. For instance, a sensitometric curve within the scope of the present invention may also be obtained by a photographic material comprising no tabular grains but only (mixtures of) cubic grains as illustrated by example 12.

TABLE 3

| | Emulsion coating weights ($g/m^2AgNO_3$) | | | | | | | | | Skin |
|---|---|---|---|---|---|---|---|---|---|---|
| | Lower emulsion layer A | | | Upper emulsion layer B | | Sensitometric results | | | | line |
| Example | T1 | C3 | C4 | C1 | C2 | Av. Grad. | Gr.SL | D.SL | PDmax | factor |
| 1 | 7.0 | — | — | — | — | 3.30 | 1.44 | 3.69 | 4.10 | 1.0 |
| 2 | — | — | — | 7.0 | — | 4.61 | 0.27 | 3.60 | 3.65 | 0.2 |
| 3 | — | — | — | 8.5 | — | 5.20 | 3.10 | 4.10 | 4.55 | 0.2 |
| 4 | 0.5 | 1.4 | — | 5.0 | — | 4.54 | 0.84 | 3.01 | 3.55 | 4.9 |
| 5 | 1.0 | 1.4 | — | 5.0 | — | 4.25 | 0.91 | 3.01 | 3.70 | 4.9 |
| 6 | 1.0 | 1.4 | — | 5.5 | — | 4.62 | 1.04 | 3.25 | 3.82 | 3.8 |
| 7 | 1.0 | 1.4 | — | 6.0 | — | 4.89 | 1.14 | 3.50 | 4.02 | 2.3 |
| 8 | 1.0 | 1.4 | — | — | 4.2 | 4.58 | 1.51 | 3.45 | 3.80 | 2.9 |
| 9 | 1.5 | 1.4 | — | — | 4.2 | 4.42 | 1.80 | 3.75 | 4.50 | 0.7 |
| 10 | 1.5 | 1.7 | — | — | 3.7 | 4.39 | 2.31 | 3.68 | 4.25 | 1.6 |
| 11 | 3.5 | 1.4 | — | 2.0 | — | 3.80 | 1.38 | 3.63 | 4.10 | 1.5 |
| 12 | — | 1.25 | 1.25 | 6.0 | — | 4.87 | 0.84 | 3.15 | 4.20 | 3.9 |

We claim:

1. A photographic material for mammography comprising a transparent support and at least one light-sensitive emulsion layer containing silver halide grains, said emulsion layer(s) being located on only one side of said support and said material being characterised by a sensitometric curve of optical density as a function of relative logarithmic exposure (hereinafter referred to as logE), having (i) an average gradation of at least 3.5 between the two points where the optical density is Dmin+1.0 and Dmin+2.5 (Dmin being defined as the optical density obtained after processing the unexposed film); and (ii) a local gradient ranging from 0.7 to 1.8 and an optical density not higher than 3.5 at the point where logE equals SP+0.8 (SP being defined as the logE at which the optical density equals Dmin+1.0); and (iii) an optical density of at least 3.7 at the point where logE equals SP+1.3.

2. Photographic material according to claim 1, wherein said average gradation between Dmin+1.0 and Dmin+2.5 is at least 4.0.

3. Photographic material according to claim 1, wherein said local gradient at SP+0.8 ranges from 1.0 to 1.5.

4. Photographic material according to claim 1, wherein said optical density at SP+1.3 is at least 3.9.

5. Photographic material according to claim 1, having a total silver coverage from 6.0 to 9.0 $g/m^2$ expressed as silver nitrate, wherein the emulsion layer(s) comprise(s) cubic or tabular silver halide grains and wherein the silver coverage of the tabular silver halide grains is lower than the silver coverage of the cubic silver halide grains.

6. Photographic material according to claim 5 wherein the tabular silver halide grains are characterised by an average thickness of at least 0.20 $\mu$m.

7. Photographic material according to claim 1 comprising two emulsion layers, wherein the lower emulsion layer coated closest to the support comprises a mixture of cubic and tabular silver halide emulsion grains.

8. Photographic material according to claim 1, having a spectral sensitivity maximum in the wavelength range from 540 to 555 nm, said maximum corresponding to an exposure amount from 5 to 80 microJoules per $m^2$ required in order to obtain an optical density of Dmin+1.0 after processing.

9. Radiological method for obtaining a diagnostic image for mammography comprising the steps of (i) composing a film-screen system by bringing a photographic material according to claim 1 into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of 38 seconds to 2 minutes.

10. Method according to claim 9, wherein said dry-to-dry processing time is 45 to 90 seconds.

* * * * *